United States Patent [19]

Williams

[11] 4,205,222

[45] May 27, 1980

[54] ELECTRODE TYPE WATER HEATING BOILER

[76] Inventor: Stanley A. Williams, 10, Durlston Rd., Poole, Dorset BH14 8PQ, England

[21] Appl. No.: 868,342

[22] Filed: Jan. 10, 1978

[30] Foreign Application Priority Data

Jan. 14, 1977 [GB] United Kingdom ..... 1461/77

[51] Int. Cl.[2] ..... H05B 3/60; H01C 10/02

[52] U.S. Cl. ..... 219/290; 219/285; 219/289; 219/291; 219/294; 338/82; 338/84

[58] Field of Search ..... 219/284–290, 219/271–276; 338/80–86

[56] References Cited

U.S. PATENT DOCUMENTS

| | | | |
|---|---|---|---|
| 1,526,758 | 2/1925 | Rauchfuss | 219/285 |
| 2,572,536 | 10/1951 | Tatem | 219/290 |
| 3,138,696 | 6/1964 | Eaton | 219/295 X |
| 3,496,334 | 2/1970 | Williams | 219/288 |
| 3,946,197 | 3/1976 | Williams | 219/290 |

*Primary Examiner*—A. Bartis

*Attorney, Agent, or Firm*—Michael J. Striker

[57] ABSTRACT

A water heater for heating water in a casing by direct passage of current between a high tension electrode and a counter electrode both in contact with water in the casing. An electrically-insulating shield arranged between the electrode and the counter-electrode, is movable relative to the electrode and the counter-electrode for the purpose of varying the length of the current path between the electrode and the counter-electrode. Means is provided for decreasing the ratio of the areas available for the flow of water in the two regions respectively between the electrode and the shield and between the shield and the counter-electrode as the length of the current path is decreased by movement of the shield relative to the electrode and counter-electrode.

12 Claims, 4 Drawing Figures

ELECTRODE TYPE WATER HEATING BOILER

Figure 1:
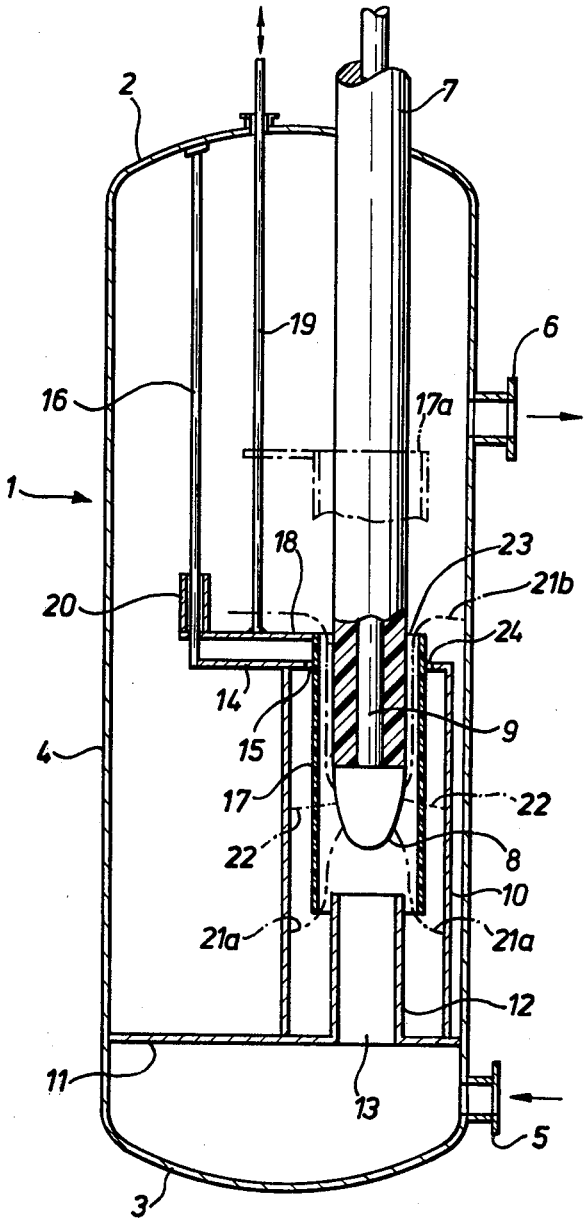

This invention relates to an improved water heater of the kind which operates at high tension (by which I mean a voltage in excess of 1 kV) and heats the water in a casing by direct passage of current between a high tension electrode and a counter-electrode at lower potential (usually earth potential), both in contact with the water in the casing. Throughout this specification the term "boiler" will be used to describe a water heater of this kind although it should be understood that in its normally intended mode of operation it will be heated water and not steam that leaves the boiler casing.

A boiler of the kind referred to is known in which the boiler casing forms the counter-electrode, the boiler comprising an inlet at or adjacent to one end of the casing for feeding water to be heated to the boiler, an outlet at or adjacent to the opposite end of the casing for passing heated water from the boiler, and means to support the electrode within the casing so that the electrode is electrically insulated from the casing and extends in the direction of flow of water as it passes from end to end of the casing. It is also known to provide this known boiler with a current modifying means in the form of a sleeve of electrically-insulating material around the electrode and which is movable axially relative to the electrode. In the maximum load position of the sleeve, the tip of the electrode projects from the forward end of the sleeve and current flows substantially radially from the electrode to the boiler casing. When the boiler is operating in this maximum load condition it is desirable that the water flows through the casing both inside and outside said insulating sleeve. In the minimum load position of the sleeve, the latter completely surrounds the electrode tip with its forward end projecting beyond the tip of the electrode and the current then has to flow inside the sleeve to both ends of the latter before it can flow substantially radially to the boiler casing. When the boiler is operating in this minimum load condition it is desirable that the water flows through the casing mainly inside said insulating sleeve. In the past no provision has been made to satisfy these conflicting water flow requirements as the boiler load varies. Instead, the water flow has been proportioned between the inside and outside of the insulating sleeve to effect a compromise between the flow requirements under maximum and minimum load conditions. The present invention aims to remedy this shortcoming of the known high tension electrode hot water boiler.

According to the invention a high tension electrode hot water boiler comprises an elongate casing, an inlet for admitting water into said casing, an outlet for leading heated water away from said casing. The inlet and the outlet are spaced apart in the elongate direction of said casing. A high tension electrode is located within said casing and electrically insulated therefrom. A counter-electrode is spaced from the high tension electrode. An electrically-insulating shield is movable between said electrode and said counter-electrode so as to vary the length of the path of a major proportion of the current flowing between said electrode and at least part of said counter-electrode. There are further provided means for varying, in dependence on the length of said current path, the ratio of the areas available for the flow of water, as it passes from said inlet to said outlet, in the two regions respectively namely between said electrode and said shield and between said shield and said counter-electrode.

In a preferred embodiment of the invention the counter-electrode is a tubular member having its longitudinal axis disposed substantially parallel to the casing axis and the major part of the water flow from said inlet to said outlet takes place through the tubular counter-electrode. The electrode is supported inside the tubular counter-electrode and said shield is in the form of a sleeve supported within the tubular counter-electrode and surrounding the electrode, said sleeve having its longitudinal axis substantially parallel to the longitudinal axis of the counter-electrode. Means is provided for effecting relative movement, substantially in the axial direction of the casing, between the electrode and said sleeve in order to vary the length of the path of a major proportion of the current flowing between the electrode and the tubular counter-electrode. In this embodiment, means is provided for varying the area available for the flow of water between the sleeve and the tubular counter-electrode, in such a way that as the relative position of the sleeve and electrode is varied to decrease the length of said current path between the electrode and the counter-electrode, an increased proportion of the water flow through the counter-electrode occurs in the space between the sleeve and the counter-electrode. The tubular counter-electrode may be an electrically-conducting member mounted inside the boiler casing, or in some cases the boiler casing itself may serve as the tubular counter-electrode by itself or with said electrically-conducting member.

In this embodiment of the invention the electrode is preferably fixed relative to the tubular counter-electrode and the sleeve is axially movable in the counter-electrode. It is then convenient to provide the counter-electrode with a fixed baffle which obstructs the flow passage for water through the counter-electrode in the space between the sleeve and the counter-electrode except for an area between the external surface of the sleeve and the edge of a clearance hole in the baffle through which the sleeve passes. By suitably shaping the external surface of the sleeve, the area of this space between the external surface of the sleeve and the edge of the clearance hole in the baffle can be made to vary as the sleeve is moved axially in the counter-electrode, so that the area in question increases as the length of said current path between the electrode and the counter-electrode is decreased by axial movement of the sleeve. As an alternative to shaping the external surface of the sleeve, a suitably shaped tubular element may be mounted on the external surface of the sleeve.

As an alternative to the shaping of the external surface of the sleeve, or in addition thereto, the internal surface of the sleeve may be shaped so that the area of the space between the external surface of the electrode and the internal surface of the sleeve can be made to vary as the sleeve is moved axially in the counter-electrode, so that the area in question decreases as the length of said current path between the electrode and the counter-electrode is decreased by axial movement of the sleeve.

As an alternative to providing the counter-electrode with a baffle, the sleeve may be provided with a baffle which moves with the sleeve and partially obstructs the flow passage for water through the tubular counter-electrode in the space between the sleeve and the counter-electrode. The area of the unobstructed part of the flow passage through the counter-electrode may be varied in a number of ways. For example, the baffle may have at least one aperture therethrough and through which a fixed rod-like element passes. This rod-like element is so shaped that as the baffle moves relative to the rod, the area of the space between the external surface of the rod-like element and the edge of the associated aperture in the baffle varies, so that this area increases as the length of said current path between the electrode and the tubular counter-electrode is decreased by axial movement of the sleeve.

A boiler in accordance with the invention may have its casing axis disposed horizontally or vertically, or at an angle between horizontal and vertical. Furthermore, the boiler may be of single phase or poly-phase (especially three-phase) design. In the latter case, the phase electrodes may be disposed in a common casing, or each phase electrode may be disposed in its own casing, for example as described in my U.S. Pat. No. 3,946,197, dated Mar. 23rd., 1976.

Figure 2:
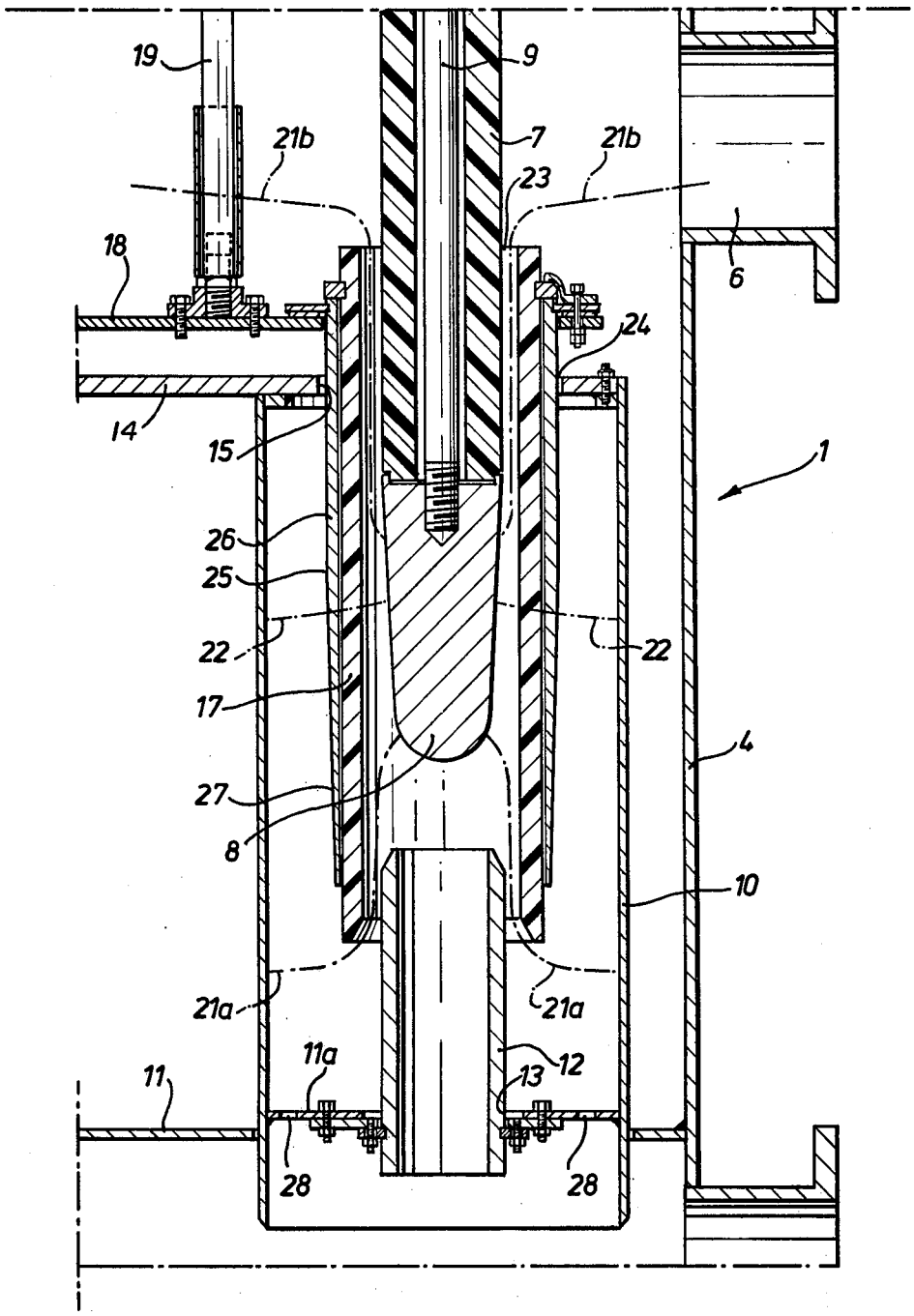
Figure 3:
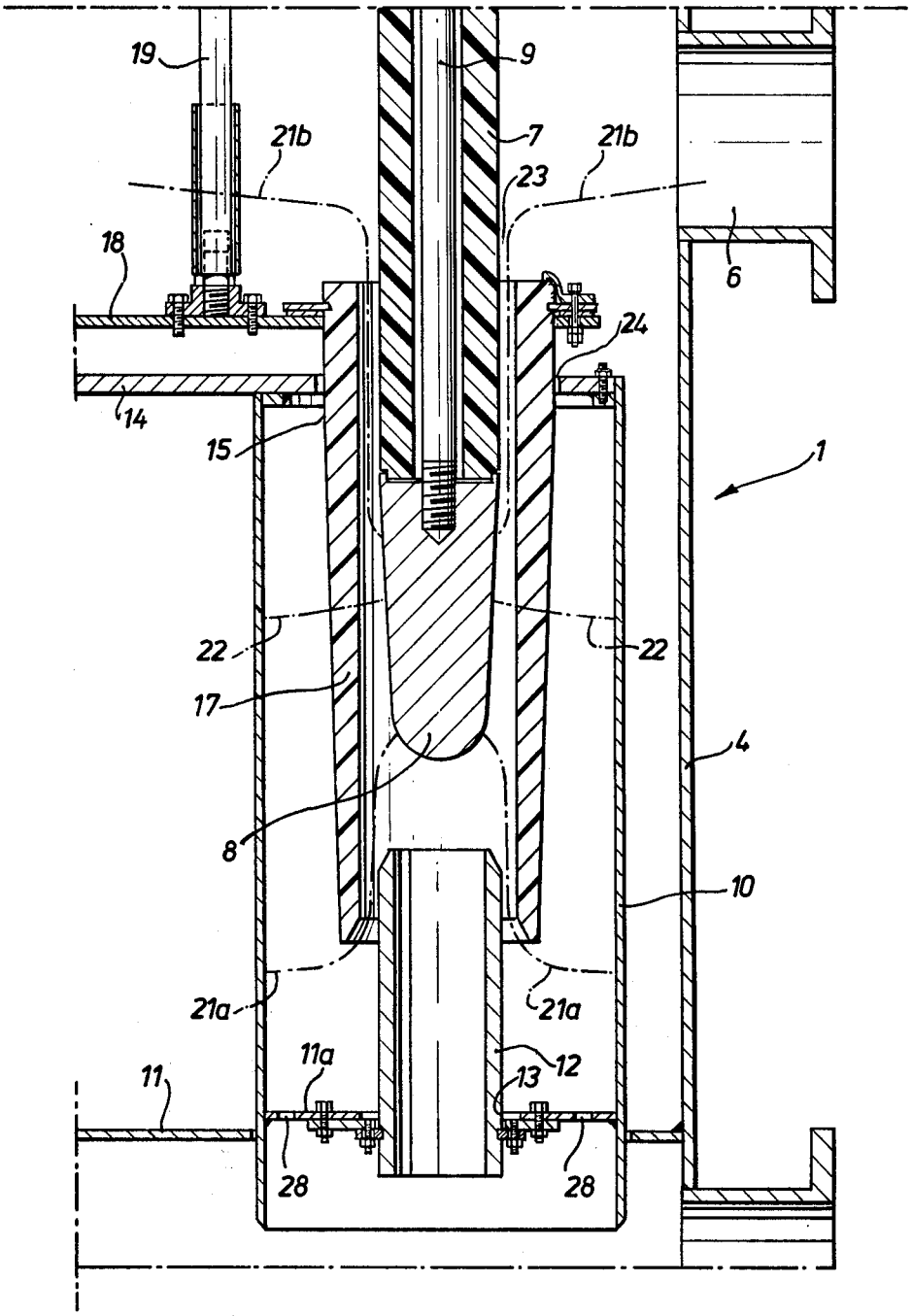
Figure 4:
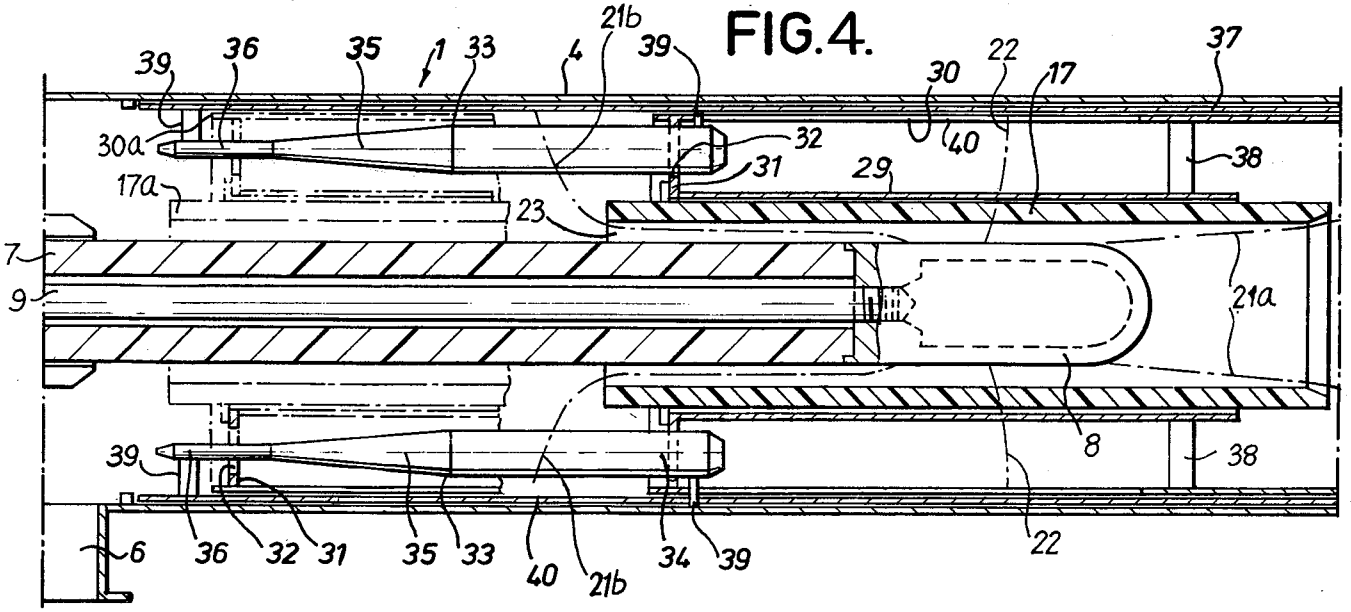

The invention will now be described, by way of example, with reference to the accompanying drawings, in which FIG. 1 is a schematic longitudinal sectional view of a first embodiment of a high tension electrode hot water boiler in accordance with the invention, FIG. 2 is a detailed sectional view, on an enlarged scale, of part of the boiler of FIG. 1, FIG. 3 is a detailed sectional view of a second embodiment of a high tension electrode hot water boiler in accordance with the invention; and FIG. 4 is a schematic longitudinal sectional view of a third embodiment in accordance with the present invention.

The boiler shown in FIG. 1 comprises a casing, generally designated by the numeral 1, which has upper and lower dome-shaped ends 2 and 3, respectively, and an intermediate cylindrical portion 4, the longitudinal axis of the casing being substantially vertical. At its lower end the casing has an inlet 5 for water to be heated in the boiler, and an outlet 6 for heated water adjacent to its upper end.

A tube 7 of electrically-insulating material passes through the upper end 2 of the casing and extends vertically downwards into the casing. Depending from the lower end of the tube 7 is an electrode 8 which is connected to an electrically-conducting rod 9 which passes through the tube 7 and has its upper end connected to a high tension supply (not shown). A hollow cylindrical counter-electrode 10 surrounds the electrode 8, the counter-electrode being fixed to a horizontal plate 11 secured to the casing 1 near the lower end of the latter. The axis of the counter-electrode 10 is vertical and aligned with the axis of the rod 9. A nozzle 12 is mounted in an aperture 13 in the plate 11, the axis of the nozzle being vertical and aligned with the axis of the rod 9. A baffle 14 having a circular hole 15 therein is secured to the upper end of the counter-electrode 10, the centre of the hole 15 lying on the axis of the rod 9. A vertical rod 16 is connected at its lower end to the baffle 14 and at its upper end to the end 2 of the casing 1. A sleeve 17 of electrically-insulating material surrounds the tube 7 and is vertically movable in the hole 15 in the baffle 14. This sleeve 17 is secured to an arm 18 which is connected to a vertically movable rod 19, the arm 18 also having a sleeve 20 secured thereto which is slidably mounted on the rod 16 and serves to guide the sleeve 17 as it is moved vertically.

FIG. 1 shows the sleeve 17 in full lines in its lowermost position in which it surrounds the electrode 8 and has its lower end positioned below the lower end of the electrode. This represents the minimum load condition of the boiler, and the current flowing between the electrode 8, on the one hand, and the counter-electrode 10 and the casing 1, on the other hand, will take one of two paths indicated by the chain lines 21*a* and 21*b*, the major proportion of the current flow being along the path 21*a*. In this minimum load condition of the boiler the length of the path 21*a* is a maximum. FIG. 1 also shows in chain lines, designated by the numeral 17*a*, the upper end of the sleeve 17 when the latter is in its uppermost position. This represents the maximum load condition of the boiler in which the major proportion of the current flow between the electrode 8 and the counter-electrode 10 takes place along a path of minimum length which is indicated by the chain lines 22.

When the boiler is in operation, water entering the inlet 5 passes up through the nozzle 12, through the hole 15 in the baffle 14 and then out through the outlet 6. In flowing through the hole 15 the water can flow either through the annular space 23 between the tube 7 and the sleeve 17 or through the annular space 24 between the sleeve 17 and the edge of the hole 15. Having regard to the disposition of the current paths 21*a,b* and 22 it is desirable that a higher proportion of the water flow takes place through the annular space 23 when the boiler is operating under low load conditions than when it is operating under high load conditions.

Referring now to FIG. 2, it will be seen that a tubular element 25 is mounted on the sleeve 17, this tubular element having an upper portion 26 of constant wall thickness and a lower portion 27 in which the thickness of the wall decreases in the downward direction. With the sleeve 17 in its lowermost position, as shown in FIG. 2, the area of the annular gap 23 is larger than the area of the annular gap 24 so that the major proportion of the water flowing upwardly through the nozzle 12, and through holes 28 in a plate 11*a* surrounding the nozzle, will flow through the annular gap 23. When the sleeve 17 is raised, so that the lower portion 27 of the tubular element 25 is disposed in the hole 15 in the baffle 14, the ratio of the area of the gap 23 to that of the gap 24 decreases, so that a greater proportion of the water flows through the gap 24 than when the sleeve 17 is in its lowermost position.

In a modified embodiment of the boiler of FIGS. 1 and 2, instead of providing the sleeve 17 with the tubular element 25, the external surface of the sleeve 17 may be shaped as shown in FIG. 3, so that the area of the gap 24 increases when the sleeve is raised from its lowermost position. In all other respects, the boiler of FIG. 3 is the same as that shown in FIGS. 1 and 2.

FIG. 4 shows another embodiment of a boiler in accordance with the invention, in which the same reference numerals have been employed as in FIGS. 1 and 2 to designate the same or similar items. In this embodiment the boiler casing 1 is arranged with its longitudinal axis horizontal and the direction of water flow is horizontal. The electrically-insulating sleeve 17 is supported in a metallic tube 29 which in turn is supported in a cylindrical cage 30 which is slidable axially within a cylindrical lining 37 mounted inside the casing 1. The casing 1 and the lining 37 serve as the counter-electrode of the boiler. The axes of the items 17, 29, 30 and 37 are all substantially coincident with the longitudinal axis of the casing 1.

Adjacent one of its ends, the tube 29 is connected to the cage 30 by radially disposed connection members 38. At its other end, the tube 29 is connected to the cage 30 by an annular baffle 31, this baffle having a number of holes 32 therethrough. Associated with each of the holes 32 is a different one of a number of rod-like elements 33, the latter being secured to the lining 37 by supports 39 and having their longitudinal axes parallel to the axis of the casing 1. Each of the elements 33 has a portion 34 of constant diameter and a frusto-conical portion 35 which tapers in the direction away from the portion 34.

FIG. 4 shows the sleeve 17 (in full lines) in the position into which it is moved when the boiler is operating under minimum load conditions. In this position of the sleeve, the cylindrical portion 34 of each element 33 is disposed in, and almost completely fills, its associated hole 32. In this position of the sleeve 17 the major proportion of the water flow takes place through the annular gap 23 between the sleeve 17 and the tube 7. The cage 30 and the sleeve 17 can be moved to the left, to the positions shown in chain lines and designated by **30*a* and 17*a*, respectively, in order to bring the sleeve 17 to the position corresponding to maximum load condition of the boiler. Axially-disposed slots 40 in the cage 30 permit sliding of the latter past the supports 39 at the right-hand end (as viewed in the FIG. 4) of the elements 33. In this maximum load position of the sleeve 17, the small diameter end 36 of each element 33 is disposed in its associated hole 32 and the proportion of the water flowing through the annular gap 23** is smaller than when the boiler is operating under minimum load conditions.

What is claimed is:

1. A high tension electrode hot water boiler comprising an elongated casing; an inlet for admitting water into said casing; an outlet for leading heated water from said casing, said inlet and outlet being spaced in the elongated direction of said casing; a high tension electrode within said casing and electrically insulated therefrom; a counter-electrode spaced from said electrode; an electrically-insulating shield spaced from said electrode and said counter-electrode to provide first and second regions for flow of water between said electrode and said shield and between said shield and said counter-electrode, respectively; means for selectively moving said shield between said electrode and said counter-electrode to vary the length of the path of a major portion of the current flowing between said electrode and at least part of said counter electrode; and means associated with at least one of said electrode, counter-electrode and shield for varying, in dependence on the length of said current path, the ratio of the area available for the flow of water, as it passes from said inlet to said outlet, in said first region relative to the available area of said second region, said ratio decreasing as the length of said current path is decreased by movement of said shield relative to said electrode and said counter-electrode.

2. A hot water boiler as claimed in claim 1, wherein said counter-electrode is a tubular member having its longitudinal axis disposed substantially parallel to the direction of elongation of said casing, and means are provided for causing the major part of the water flow from said inlet to said outlet to take place through the tubular counter-electrode.

3. A hot water boiler as claimed in claim 2, comprising means supporting said electrode inside the tubular counter-electrode.

4. A hot water boiler as claimed in claim 3, wherein said shield is in the form of a tubular sleeve and means is provided for supporting said sleeve for movement within said tubular counter-electrode with the longitudinal axis of said sleeve substantially parallel to the longitudinal axis of said tubular counter-electrode.

5. A hot water boiler as claimed in claim 4, wherein said means for selectively moving said shield effects relative movement, substantially in the elongate direction of said casing, between said electrode and said sleeve, in order to vary the length of said path.

6. A hot water boiler as claimed in claim 5, in which said electrode is fixed relative to said counter-electrode and said sleeve is axially movable in said counter-electrode.

7. A hot water boiler as claimed in claim 6, in which said counter-electrode is provided with a fixed baffle which obstructs the flow passage for water through said counter-electrode in the space between said sleeve and said counter-electrode except for an area between the external surface of said sleeve and a clearance hole in said baffle through which said sleeve passes.

8. A hot water boiler as claimed in claim 7, wherein said means for varying the ratio comprises the external surface of said sleeve being shaped so that the area of said space between the external surface of said sleeve and the edge of said clearance hole varies as the sleeve is moved axially in said counter-electrode.

9. A hot water boiler as claimed in claim 6, in which said sleeve is provided with a baffle which moves with the sleeve and partially obstructs the flow passage for water through said tubular counter-electrode in the space between said sleeve and said counter-electrode.

10. A hot water boiler as claimed in claim 9, wherein said means for varying the ratio includes at least one aperture through said baffle and a fixed rod-like element extending through each of said at least one aperture, said rod-like element being shaped so that as said baffle moves relative to the rod-like element, the area of the space between the external surface of said rod-like element and the edge of said aperture varies.

11. A high tension electrode hot water boiler comprising a casing; an elongated electrode within said casing; a tubular counter electrode around said electrode with its longitudinal axis substantially parallel to the longitudinal axis of said electrode; a tubular electrically insulating shield disposed inside said counter-electrode and around said electrode with the longitudinal axis of said shield disposed substantially parallel to the longitudinal axis of said counter electrode; means for moving said shield axially between said electrode and said counter-electrode, to vary the length of the path of a major proportion of the current flowing between said electrode and at least part of said counter-electrode; means for directing water to be heated in the boiler through a first region between said electrode and said shield and through a second region between said shield and said counter-electrode; and means for varying the ratio of the area of said first region with respect to the area of said second region in dependence on the length of said current path, said ratio decreasing as the length of said current path is decreased by movement of said shield relative to said electrode and counter-electrode.

12. In a high tension electrode hot water boiler comprising a casing; an elongated electrode within said casing; a tubular counter-electrode around said electrode with its longitudinal axis substantially parallel to the longitudinal axis of said electrode; a tubular electrically insulating shield disposed inside said counter-electrode and around said electrode with the longitudinal axis of said shield disposed substantially parallel to the longitudinal axis of said counter-electrode; means for causing relative movement in the direction of the longitudinal axis of said counter-electrode between said electrode and said shield to vary the length of the path of a major portion of the current flowing between said electrode and at least part of said counter-electrode; and means for directing water to be heated in the boiler through a first-region between said electrode and said shield and through a second region between said shield and said counter-electrode, the improvement which consists in the provision of means for varying the ratio of the area of said first region relative to the area of said second region in dependence on the axial position of said sleeve in relation to said electrode, said ratio decreasing as the length of said current path is decreased by movement of said shield relative to said electrode and counter-electrode.

* * * * *